US006154546A

United States Patent [19]

Uvacek

[11] Patent Number: 6,154,546

[45] Date of Patent: Nov. 28, 2000

[54] PROBE MICROPHONE

[75] Inventor: Bohumir Uvacek, Mountain View, Calif.

[73] Assignee: Resound Corporation, Redwood City, Calif.

[21] Appl. No.: 08/993,341

[22] Filed: Dec. 18, 1997

[51] Int. Cl.[7] ..... H04R 29/00

[52] U.S. Cl. ..... 381/60; 73/585

[58] Field of Search ..... 73/585; 181/131; 381/60, 56, 57, 58, 312, 321, 328

[56] References Cited

U.S. PATENT DOCUMENTS 4,548,082 10/1985 Engebretson et al. .
4,827,525 5/1989 Hotvet et al. .
4,879,749 11/1989 Levitt et al. ..... 381/60
4,901,353 2/1990 Widin ..... 381/60
5,136,656 8/1992 Frederiksen et al. ..... 381/56
5,226,086 7/1993 Platt ..... 381/60

*Primary Examiner*—Vivian Chang
*Attorney, Agent, or Firm*—Burns, Doane, Swecker & Mathis, LLP

[57] ABSTRACT

Real ear measurements for a digital hearing aid (DHA) fitting are effected using a probe microphone which senses sound from within the patient's ear. The sound, which is conveyed to the probe microphone using a probe tube, is converted to electrical signals which are input to a direct audio input of the DHA. The electrical signals are digitized by the DHA and relayed to a processing unit which effects the real ear measurements. Alternatively, the DHA itself performs all real ear measurements with only a wired, wireless or no external connection to a command unit.

6 Claims, 6 Drawing Sheets

PROBE MICROPHONE

BACKGROUND OF THE INVENTION

1. Field of the Invention

The invention relates to digital hearing aids, and more particularly, to real ear measurement systems for use during hearing aid fitting procedures.

2. Description of Related Art

In present hearing aid fitting systems, the testing methodologies can be considered to be of two different types: either electro-acoustic types of measurements or psycho-acoustic types of measurements. Historically, standardized electro-acoustic measurements have been coupler or real ear based. Coupler-based tests effectively measure some of the electro-acoustic characteristics of the transducers and sound processing of the hearing aid device. The electro-acoustic measurements can also be used to prescribe certain fitting parameters based on gain rules. Real ear measurements have these test capabilities as well. Real ear tests have the added advantage of being in situ rather than test box measurements. Real ear measurements can show the effects of ear canal resonance, head shadow, and venting. With real ear measurements, fitting parameters can be defined using ear canal resonance and targeted in situ gain data.

Even though real ear and coupler measurements provide decibel (Db) sound pressure level (SPL) responses for the fitted hearing device, these measurements do not indicate if the frequency specific amplification delivered in the ear canal is audible or comfortable. For psycho-acoustic test measurements, loudness growth and octave bands (LGOB) measurements are the primary standardized psycho-acoustic test measurements. The need for a clinical measurement of loudness is indicated by "abnormal growth of loudness" characteristics of many patients with sensori-neural and mixed hearing impairments. Such patients exhibit a level and frequency dependent sensitivity to sounds. Because of the patient's reduced dynamic range, the intensity variation of speech and noise are perceived to be exaggerated (in other words, the intensity rises too rapidly from inaudible to soft and from soft to loud). Because loudness sensitivity measurements are highly indicative of the patient's unaided and aided ability to comfortably process loud and soft sounds, LGOB testing allows the clinician to both measure the recruitment of the patient and to use the test results to define fitting parameters.

In these tests, a loud speaker is typically used to deliver the sound source and a probe tube is placed in the ear canal for measuring the sound pressure levels from the sound source. The sound source will typically present an uneven sound field in the room because standing waves that are reflected from the walls will create nulls at approximately 10 centimeters with differences of 20 dB levels. Also, if the user turns his or her head away from the loudspeakers, shadows will be cast which create gain differences of as much as 15 dB. In addition, cost constraints often restrict the size of the testing office, and accordingly a sufficiently large enough distance from the loud speaker to the user may not be accommodated. As a result, these measurements have various degrees of stability and reliability due to the sound presentation.

One known solution for this problem is to make use of a calibrated microphone. In addition to the probe microphone placed in the ear canal, another microphone is placed next to the ear canal entrance at a fixed position. The calibrated microphone is first used to detect the sound presented by the loud speaker and then the microphone registers this level.

Thereafter, the calibrated microphone is used to feed back signals for adjusting the sound level of the loud speaker and effectively changing its volume control based upon this registered level. However, the use of such a calibrated microphone undesirably adds additional components and complexity to the system.

During the fitting process of a patient's hearing instruments, the above measurements are made using the microphones of the hearing instrument. Calibration of the hearing instrument is effected using the sound level as presented to the hearing instrument, and then as processed by the hearing instrument and presented to the patient's eardrum. The result is a calibrated instrument which compensates for the variable acoustics of the particular hearing environment.

A drawback of the fitting process is its requirement of complex computing equipment which adds considerable expense and bulk to the fitting process. Additionally, the assembly of the various components and their fitting to the patient during the fitting procedure consumes valuable testing time, inconveniently extending the duration of the fitting process.

Thus there exists a need to simplify the fitting process and make it more convenient and inexpensive for the patient and the dispenser. Such simplification, through a reduction in the amount and size of computation equipment and time required for fittings, increases patients' access to required hearing instruments.

SUMMARY OF THE INVENTION

The present invention takes advantage of certain aspects of digital hearing aids (DHA). A DHA can compute the RMS value of a sound signal and send it to an attached processing system for display and fitting measurements and calculations. Alternatively, the DHA itself can be used to effect the fitting measurements without resort to an external processing system. By using the digitized waveforms generated in conventionally available DHAs, the system of the invention reduces the complexity of the fitting process and achieves the necessary calibration required for testing and proper calibration of the hearing instrument without reliance on the complex and expensive equipment and procedures of previous systems.

According to the invention, a calibrated microphone is used for sensing the outside sound levels and the sound levels at the eardrum when the hearing instrument is inserted in the patient's ear. Accordingly, a calibrated microphone is connected to the digital audio input (DAI) of the DHA to achieve a fully functioning real ear measurement system. Exposed to the free air, it helps to calibrate the DHA's own microphone to obtain a free field sound reference.

The present invention uses a probe microphone which is connected to a short tube placed inside the ear canal. The probe microphone senses the eardrum sound pressure levels along with outside acoustic levels and thus furnishes the necessary calibration information. The output of the probe microphone is connected to the DAI (digital audio input) of the hearing instrument which then processes the information to yield a digitized representation thereof. This digitized representation can then be conveyed, through direct wiring or wirelessly to the remote processing system to effect the fitting computations, or alternatively, is processed by the DHA itself to provide the necessary fitting information. It is to be understood that the information exchange between the DHA and the remote processor may be bidirectional, with each component both transmitting to and receiving information from the other component.

The system of the invention is applicable to both in the ear (ITE) and behind the ear (BTE) hearing instruments, with various adaptations of the probe microphone being available for each. Moreover, directional type instruments are accommodated by the invention, which in the corresponding embodiments use, as the probe microphone, one of the multiple microphones characteristic of such instruments.

The invention also makes use of various range extending schemes which expand the system's acoustic range and which may be implemented using either a multiple microphone system or a switchable circuit which varies the sensitivity of a single microphone. The range extending schemes are also applicable to both conventional and directional type DHAs.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENTS

Figure 1:
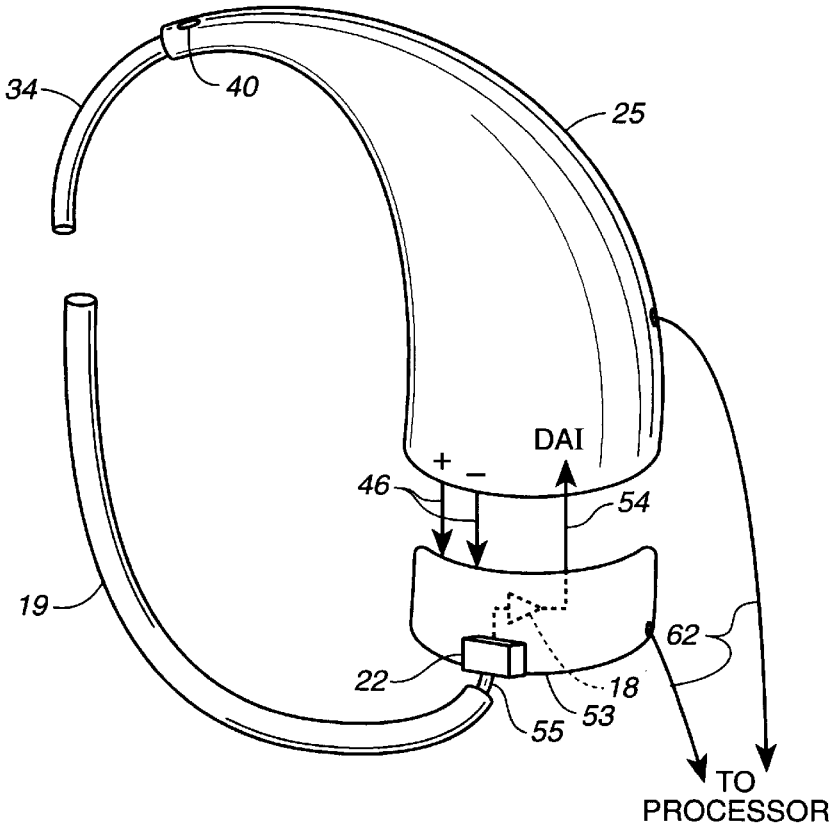
FIG. 1 is a schematic view of an arrangement for effecting real ear measurements using a BTE device in accordance with the invention.
Figure 2:
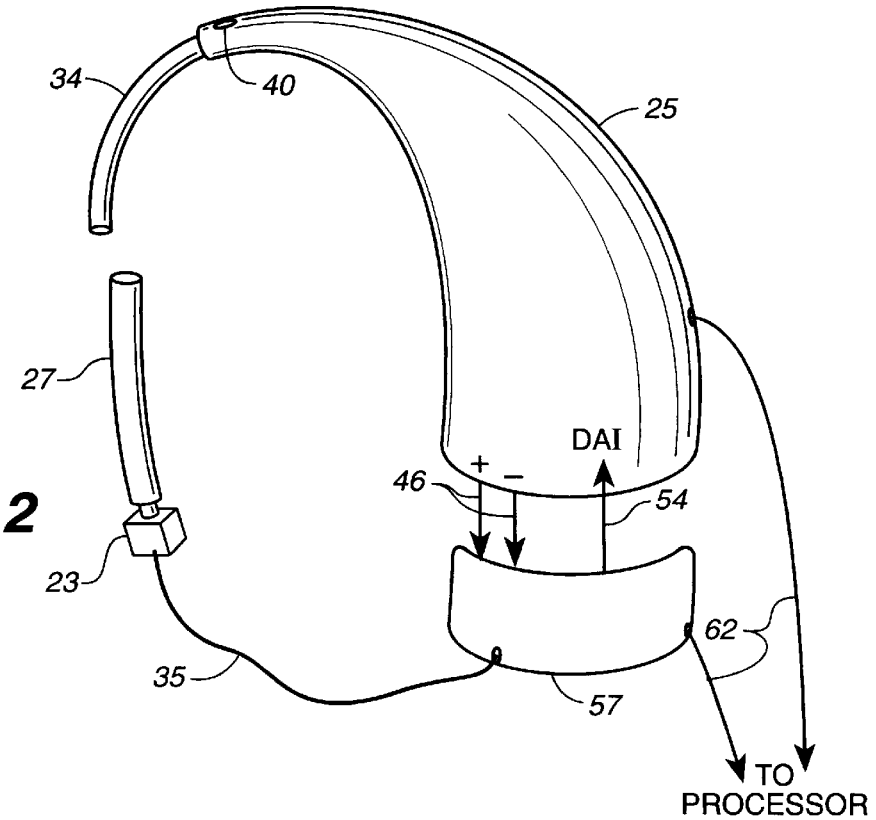
FIG. 2 is a schematic view of an arrangement for effecting real ear measurements in the BTE of FIG. 1, wherein probe tube length is minimized.
Figure 3:
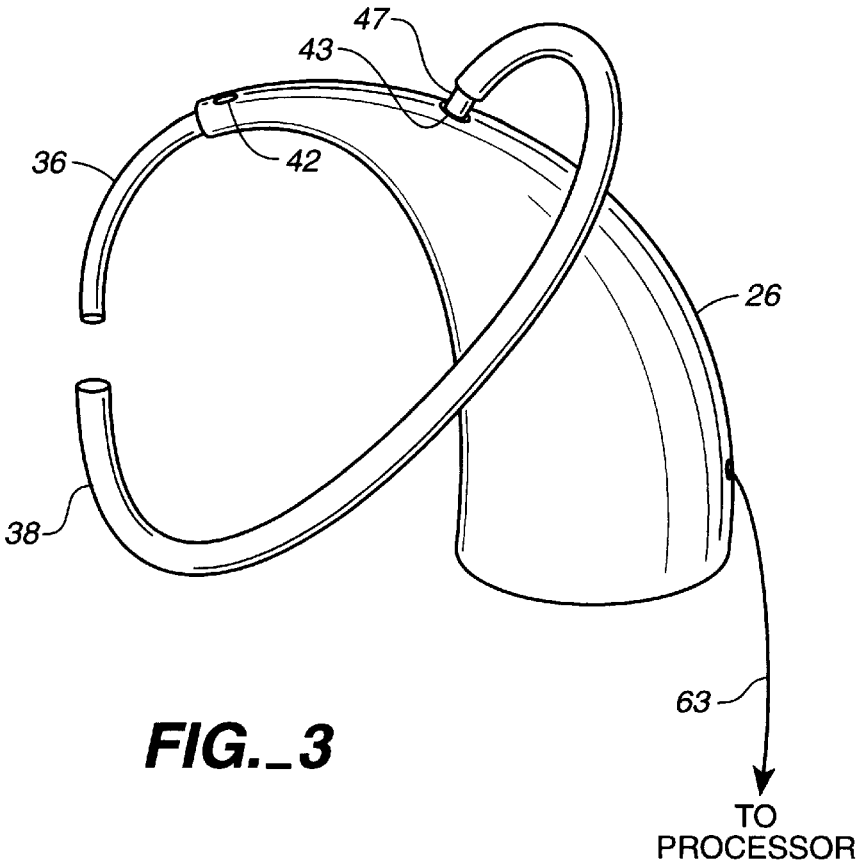
FIG. 3 is a schematic view of an arrangement for effecting real ear measurements using a directional type BTE device in accordance with the invention.

FIGS. 1–3 show applications of the invention in conjunction with BTE (behind the ear) hearing instruments. In FIG. 1, a conventional, single microphone DHA (digital hearing aid) is used. DHA 25, which has a tone tube 34 and a microphone 40, is connected to a boot probe microphone 22 via boot 53. The connection may be mechanical, in that the boot 53 is adapted to, for example, snap into place in attachment with a portion of the DHA 25. Other mechanical connection schemes are contemplated. Additionally, boot 53 and DHA 25 are in electronic communication with each other, with signals from the boot probe microphone 22 being fed into the direct audio input (DAI) of the DHA 25 for processing thereby. A cable 54 is provided for this purpose, although alternatively, for example in a snap-on version (not shown), corresponding conductive contact regions provided on each of the boot 53 and DHA 25 and adapted to come into contact with each other when the boot is snapped into place on the DHA 25 may be provided. Similarly, power cables 46, which are provided for powering the boot probe microphone 22 by the DHA 25, may be dispensed with in a snap on arrangement which uses conductive contact leads on the boot 53 and the DHA 25. The power source used (not shown) may be the DHA's own power supply or a power supply provided for the purpose of the real ear measurements.

The boot probe microphone 22 may be disposed internally or externally of the boot 53. Moreover, boot 53 may contain support circuitry such as pre-amplifiers (18) to boost the microphone input signals. Sound from inside the ear is conveyed to the boot probe microphone 22 via a probe tube 19, which may be connected at its proximal end to the boot probe microphone 22 directly or using an adapter scheme involving, for instance, a secondary adapter tube 55 inside or outside of which probe tube 19 is fitted. The probe tube 19 extends past the ear mold (not shown) normally worn by the patient such that its distal end is inside the ear in the vicinity of the patient's eardrum. The boot probe microphone 22 is appropriately calibrated for the fitting task and is preferably a very low noise device to compensate for the sound pressure attenuations of the probe tube 19, while the tube itself is kept short to minimize the attenuations.

Boot 53 and DHA 25 are in communication with a processing unit (not shown) which serves to effect the fitting computations. Although cables 62 are shown as provided for this purpose, an alternative embodiment contemplates the use of a wireless radio frequency (RF) link for communication between the components.

In operation, sound signals detected inside the patient's eardrum are relayed by probe tube 19 to boot probe microphone 22, which produces an electrical representation thereof. This representation, indicative of acoustic levels outside as well as acoustic levels within the ear canal, is fed to the direct audio input (DAI) of the digital hearing aid (DHA) 25, which in turn converts these to digitized waveforms based on computed RMS values of the received signals. The information is conveyed to the processing system which then carries out the real ear measurements necessary for appropriate fitting of the DHA 25. The computations also entail measurements of the free air sound using the DHA microphone 40. Of course, it is contemplated that the DHA itself can implement the real ear measurements and compute and memorize parameters in some situations without the need to resort to an external processing system.

FIG. 2 shows a second embodiment of the invention, whose principal difference from the FIG. 1 embodiment is the length of the probe tube. Since the probe tube acts as an attenuator which in practice distorts certain features of the sound signal, it is advantageous to minimize its length in many applications. Hence as seen FIG. 2, probe tube 27 is represented as shorter than probe tube 19 of the previous embodiment. The proximal end of probe tube 27 is connected, possibly via an adapter, to probe microphone 23, which is in electrical communication with boot 57 via cable 35. Boot 57 otherwise engages DHA 25 in the manner discussed above with reference to boot 53, while communication with the processor (not shown), when required, is also similarly effected via cables (62) or in the wireless manner explained above.

The teachings of the invention can be practiced with a directional type hearing instrument as well, as shown in FIG. 3. This type of DHA utilizes two microphones whose outputs are processed by the DHA for improved directional performance. FIG. 3 shows a DHA 26, which comprises tone tube 36, front microphone 42, and rear microphone 43. Connected to one of the microphones, preferably the rear microphone 43, and possibly via an adaptor 47, is probe tube 38 adapted to be fitted inside the ear of the patient and to convey sound signals therefrom to the microphone 43. The microphone used in the measurement, in this case rear microphone 43, is preferably of an extremely low noise type to compensate for sound pressure attenuation by the probe tube 38.

The sound signals received by the rear microphone 43 generate corresponding electrical signals which are then processed internally by the DHA 26, with DHA 26 converting them to digitized waveforms based on computed RMS values. Calibration is then effected, either externally or internally, with the information being conveyed, in the external situation, to the processing system for carrying out the real ear measurements necessary for appropriate fitting of the DHA 26. Signals from the front microphone 42, representative of the free air sound level, are also employed in the real ear measurements.

Figure 4:
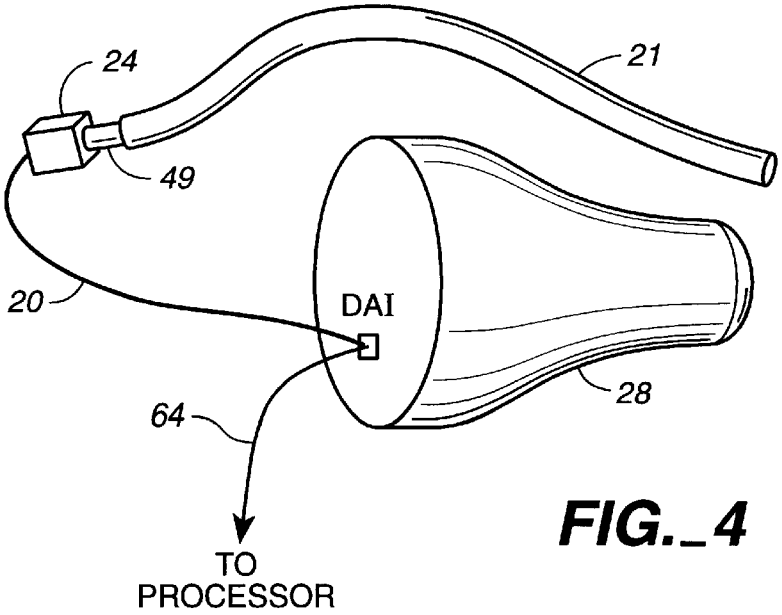
FIG. 4 is a schematic view of an arrangement for effecting real ear measurements using an ITE device in accordance with the invention.
Figure 5:
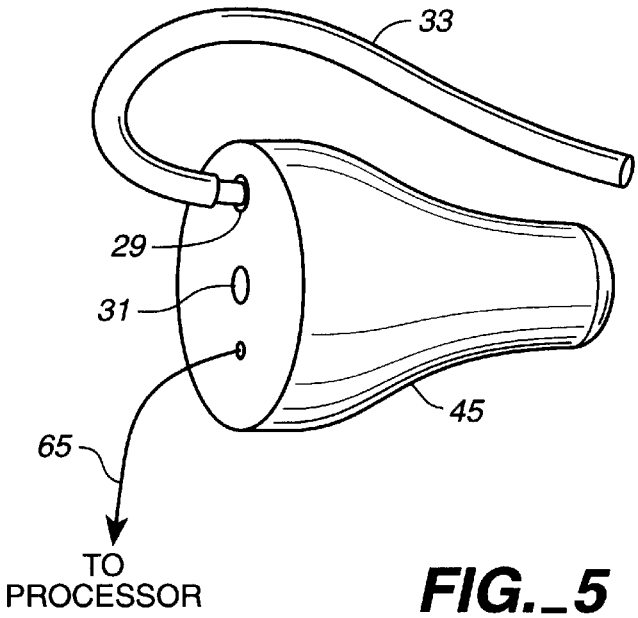
FIG. 5 is a schematic view of an arrangement for effecting real ear measurements using a directional type ITE device in accordance with the invention.

FIGS. 4 and 5 pertain to the practice of the invention in conjunction with an ITE (in the ear) digital hearing instrument. Specifically, FIG. 4 shows a conventional ITE 28, to the direct audio input (DAI) of which is connected a cable 20 which feeds the output of probe microphone 24 to the ITE 28. Probe microphone 24 converts to electrical signals sound signals, conveyed thereto by probe tube 21, from within the patient's ear. A connection with the processor, not shown, is made via cable 64, or alternatively, in a wireless manner as discussed above. The connection between the proximal end of probe tube 21 and probe microphone 24 may be made using an adapter 49.

In FIG. 5, a directional type ITE 45 is used in the invention. The probe tube 33 conveys sound signals from within the patient's ear to one of the two microphones (29, 31) with which the directional type ITE 45 is equipped. These signals are electrically converted by microphone 29 and digitized in ITE 45, and the appropriate information may then be relayed to the processor, wirelessly or via wires 65, for making the real ear measurements as discussed above.

Figure 6:
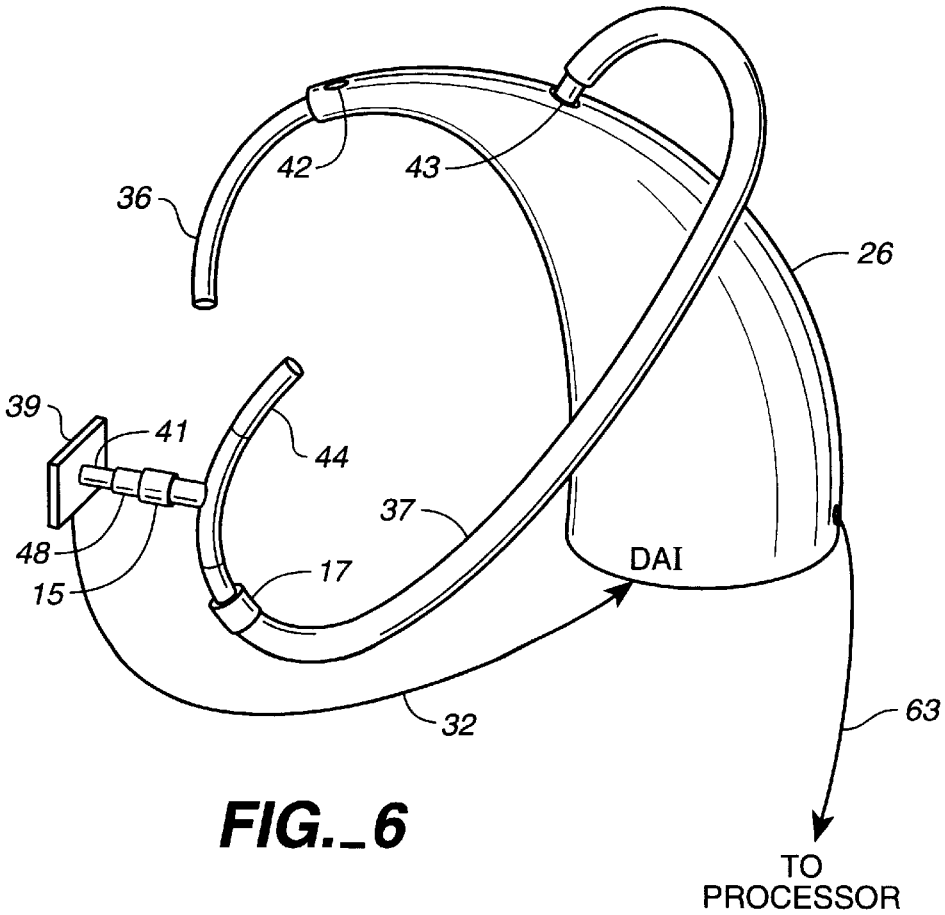
FIG. 6 is a schematic view of an arrangement for effecting real ear measurements using a directional type BTE device in conjunction with a third microphone for improved sound level sensitivity.

The dynamic range of the system of the invention may be increased using the embodiments of FIGS. 6–10. FIG. 6 shows the use of two microphones—namely, rear microphone 43 of DHA 26 and probe microphone 39—each having a different sensitivity range to provide a wider range than would be possible with a single microphone used in the real ear measurements. Typically, the maximum response of the microphones 42 and 43 provided with directional type DHA 26 is below 100 dB, and frequently at around 80 dB. However, in some applications sound levels within the patient's ear can reach as high as 150 dBs, levels which would overload the DHA microphone and saturate a typical supporting circuit. One possible inexpensive solution contemplated by the invention involves reliance on the inherent sound pressure attenuations attendant the use of the probe tubes of the above embodiments. However, this solution, although reducing the number of microphones required, is not satisfactory in many applications because the attenuation is peaky rather than flat, and is particularly pronounced at the high frequency region, thereby undesirably distorting the character of the sound signal. Another limitation is that while the eardrum sound pressure range is 0–150 dB SPL, the dynamic range of the DAI (digital audio input) of a typical hearing instrument is 30–90 dB.

As shown in FIG. 6, a T-piece 48 is provided to channel the sound signal conveyed thereto by short probe tube 44 (preferably 10–20 mm in length) towards two microphones, probe microphone 39 and directional type DHA rear microphone 43. Sound signals from within the patient's ear reach the T-piece 48 through the short probe tube 44. T-piece 38 then directs these sound signals via long tube 37 to rear microphone 43 and via an adapter 41 to probe microphone 39. The signal from the probe microphone 39 is connected to the DAI (direct audio input) of the DHA 26 by cable 32. Also shown in FIG. 6 are acoustic dampers 15 and 17 which may optionally be used to appropriately shape the sound signal.

In operation, rear microphone 43, along with the long tube 37, serves to sense the high level eardrum sounds, while the probe microphone 39 senses the low level eardrum sounds. Front microphone 42 senses outside sound levels as required for the real ear measurement process. The signals are appropriately digitized by the DHA 26 and conveyed to the processor, by direct wiring (wires 63) or wireless connection, for effecting the real ear measurements.

Figure 7:
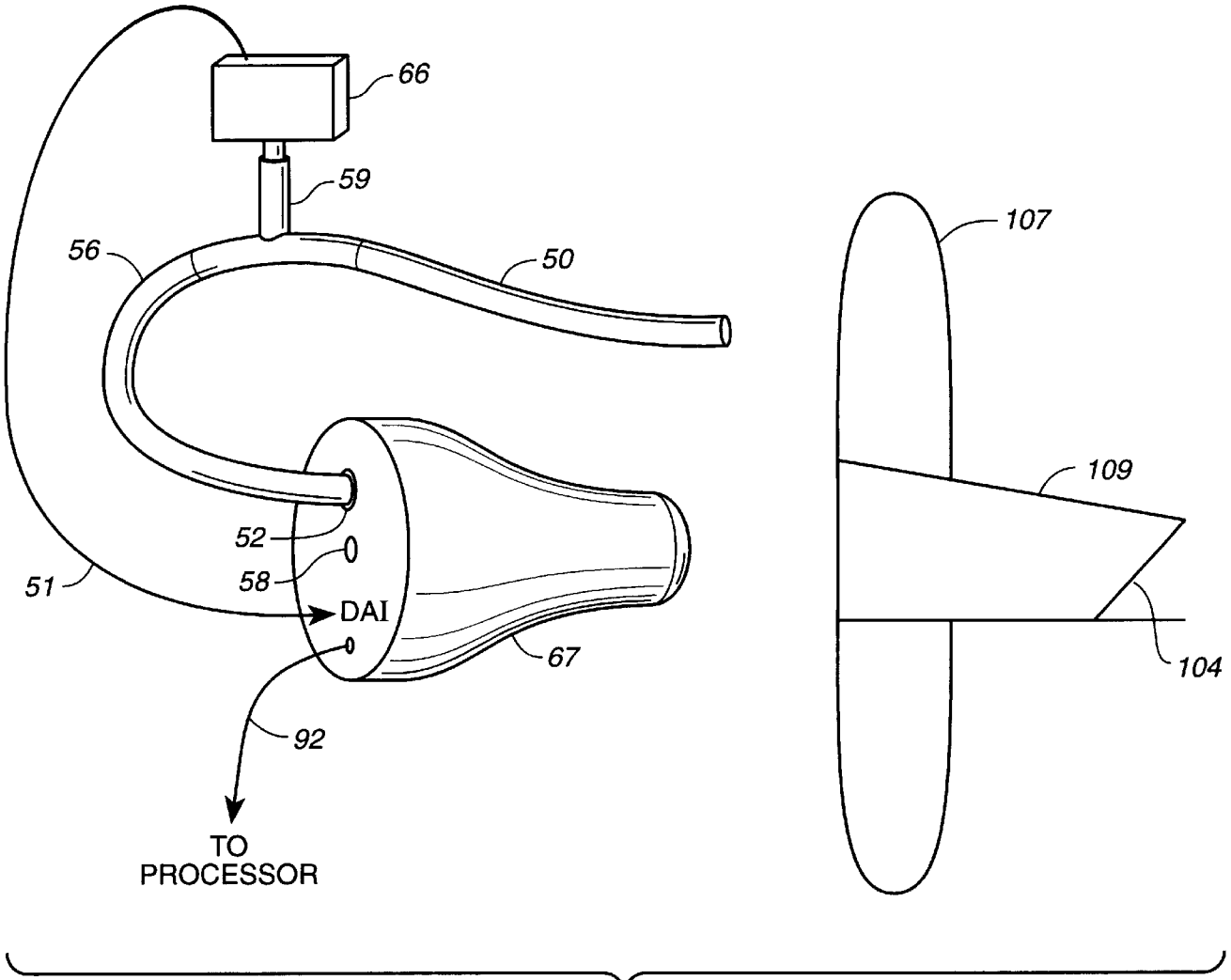
FIG. 7 is a schematic view of an arrangement for effecting real ear measurements using a directional type ITE device in conjunction with a third microphone for improved sound level sensitivity.

FIG. 7 shows an embodiment for use with a directional type ITE (in the ear) device. Short tube 50, in conjunction with T-piece 59 and long tube 56, operate to channel sound signals from the inside of the patient's ear to probe microphone 66 and to one of the two directional microphones (52, 58) of DHA 67. The other DHA microphone, in this case microphone 58, operates to sense the free air sound levels necessary for effecting the real ear measurements. These measurements are performed by the processor (not shown) whose inputs are derived from the output of DHA 67 as relayed either wirelessly or via cable 92. In FIG. 7, the ear of the patient is also schematically shown, with the pinna being denoted by the reference numeral 107, the ear canal by 109 and the eardrum by reference numeral 104.

Figure 8:
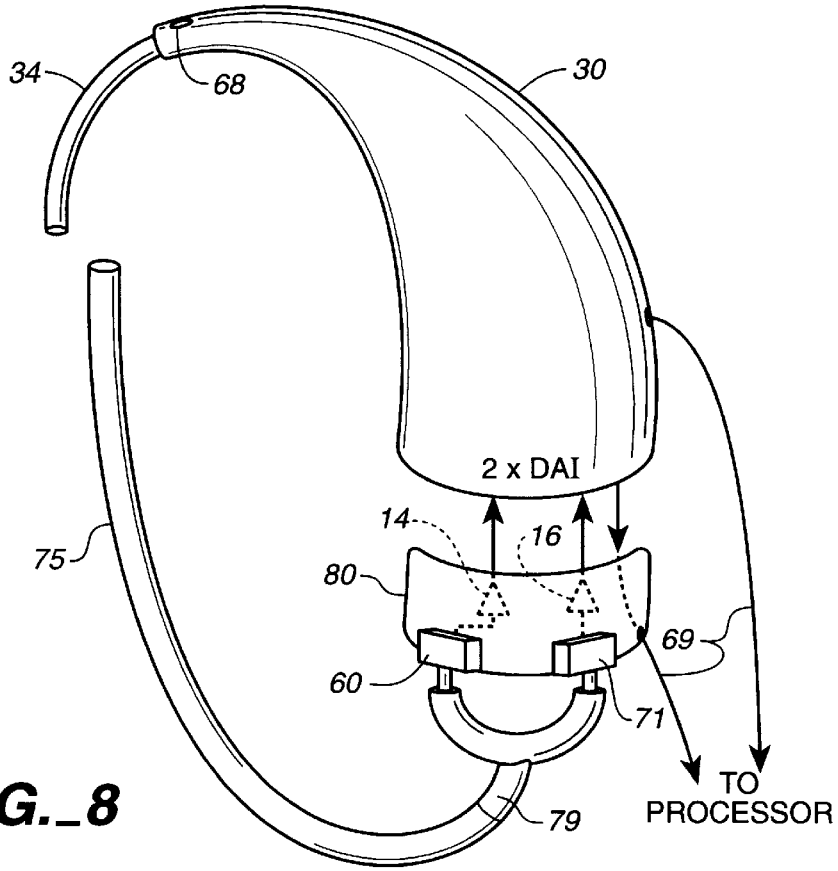
FIG. 8 is a schematic view of an arrangement for effecting real ear measurements using a BTE device in conjunction with two probe microphones for improved sound level sensitivity.

FIG. 8 shows the use of two microphones, 60 and 71, having different dynamic ranges whose outputs are fed to DHA 30 via associated direct audio input connections. The microphones, and, optionally, preamplifiers 14 and 16, may be disposed within a boot 80 and are in communication with the patient's ear through tube 75 and T-piece 79 as illustrated. Any known electronic switching scheme (not shown) may be employed to selectively activate one microphone while deactivating the other microphone. Microphone 68 senses ambient sound for processing by DHA 30 and the processor in making the real ear measurements. Cable 69, which may be dispensed with in a wireless variation, delivers the signals to the processor.

Figure 9:
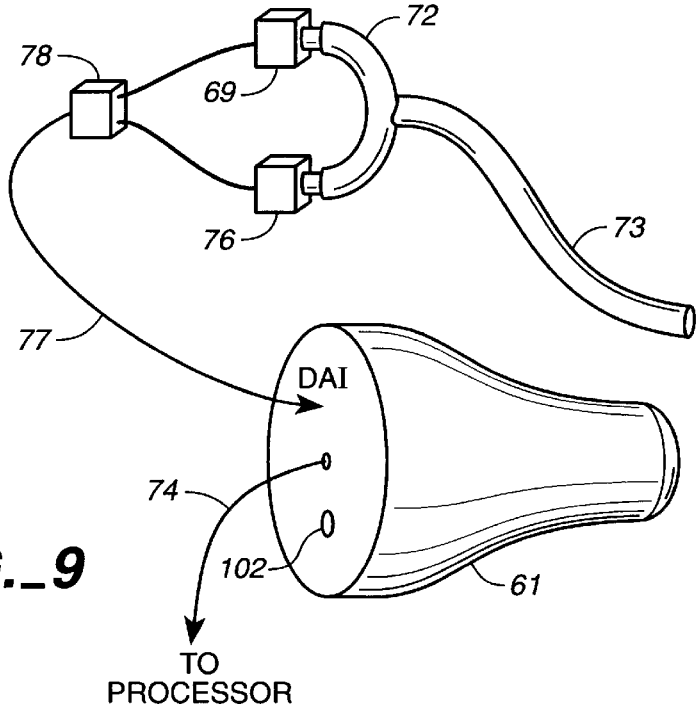
FIG. 9 is a schematic view of an arrangement for effecting real ear measurements using a ITE device in conjunction with two probe microphones for improved sound level sensitivity.

FIG. 9 shows a system similar to that of FIG. 8 but adapted for use with an ITE (in the ear) hearing device 61. Tube 73 conducts sound, via T-piece 72, to microphones 69 and 76. Each microphone has a different sensitivity range, with switching circuit 78 operating to electronically select which microphone output is conveyed, via cable 77, to the digital audio input of the ITE 61. Signals from the microphones 69 and 76, along with those from microphone 102 of the hearing ITE 61, are digitized and relayed to the processor wirelessly or by cable 74.

Figure 10:
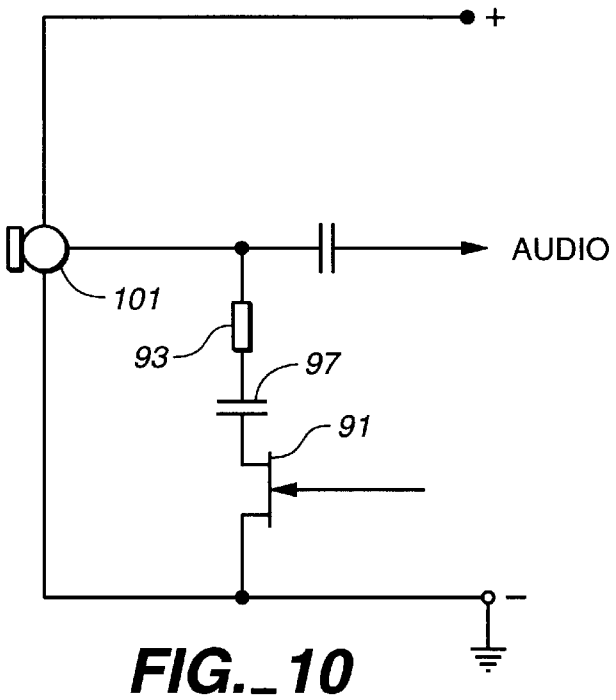
FIG. 10 is a schematic diagram of a first circuit used for providing a dual range for a microphone used in a real ear measurement in accordance with the invention.
Figure 11:
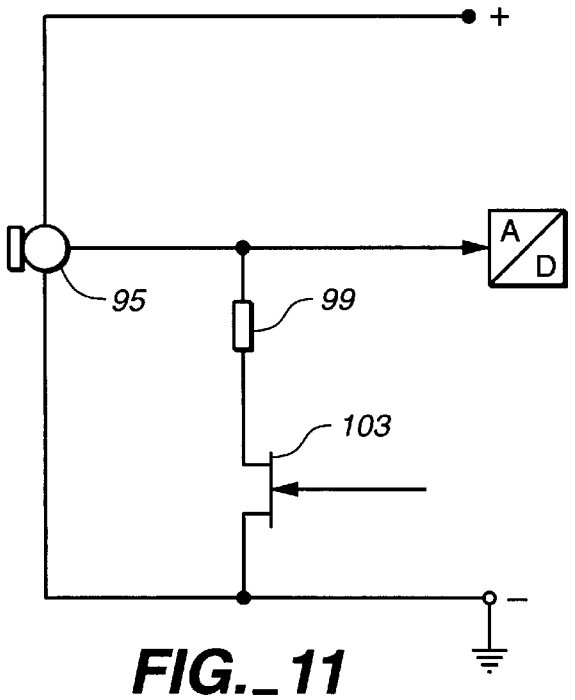
FIG. 11 is a schematic diagram of a second circuit used for providing a dual range for a microphone used in a real ear measurement in accordance with the invention.

Alternatively, the invention can use a single microphone having selectively different sensitivity ranges. In FIG. 10, an attenuator circuit which electronically changes the range of one microphone to effectively achieve dual range performance is schematically shown. The circuit, comprising microphone 101 connected to resistor 93 and capacitor 97, further comprises a switching device such as FET switch (91) which, when turned on, shorts the microphone 101 to ground to thereby desensitize it to the higher signal levels. It should be noted that the microphone can also be shorted to virtual ground or $V_{DD}$ (not shown), which in some applications is the lower of two voltage states at which the circuit operates. When the FET switch 91 is switched off, the range of microphone 101 is restored to the higher sensitivity for appropriate sound levels. A similar circuit, using FET switch 103, resistor 99, and microphone 95, is shown in FIG. 11 and also operates to desensitize the microphone 95 to the higher sound levels when the shorting FET switch 103 is conducting.

The above are exemplary modes of carrying out the invention and are not intended to be limiting. It will be apparent to those skilled in the art that modifications thereto can be made without departure from the spirit and scope of the invention as set forth by the following claims.

What is claimed is:

1. A method for making real ear measurements during a patient fitting of a digital hearing aid (DHA), the DHA having a direct audio input and at least one DHA microphone, the method comprising the steps of:

converting sound signals into a first electrical signal using a first DHA microphone;

directing sound signals from a region inside the patient's ear to a first probe microphone disposed exteriorly of the DHA;

converting the directed sound signals into a corresponding second electrical signal using the first probe microphone; and digitizing the first and second electrical signals using the DHA to thereby generate digital representations of the first and second electrical signals, wherein the step of converting the directed sound signals comprises:

sensing an output of the first probe microphone using a switchable circuit, the switchable circuit capable of switching between a first mode responsive to a first sound range and a second mode responsive to a second sound range, the first and second sound ranges being substantially different from one another;

sensing the output of the first probe microphone in the first mode; and sensing the output of the first probe microphone in the second mode, and wherein the switchable circuit is an attenuator with ON/OFF states, the attenuator comprising a circuit connected to a switching device such that the circuit is connected to any one of the voltage levels comprising ground, virtual ground, or $V_{DD}$ when the switching device is switched on in the first mode and is disconnected from said voltage level when the switching device is switched off in the second mode, $V_{DD}$ representing the lower of two power supply levels connected to the attenuator.

2. The method of claim 1, wherein the circuit comprises a resistor and switching device comprises a FET or a bipolar transistor.

3. The method of claim 2, wherein the circuit comprises at least one of a resistor and a capacitor connected in series.

4. A method for making real ear measurements during a patient fitting of a directional digital hearing aid (DHA) having first and second external microphones, the method comprising the steps of:

converting sound signals into a first electrical signal using the first external microphone;

directing sound signals from a region inside the patient's ear to the second external microphone;

converting the directed sound signals into a corresponding second electrical signal using the second external microphone; and digitizing the first and second electrical signals using the directional DHA to thereby generate digital representations of the first and second electrical signals, wherein the step of converting the directed sound signals comprises:

sensing an output of the probe microphone using a switchable circuit, the switchable circuit capable of switching between a first mode responsive to a first sound range and a second mode responsive to a second sound range, the first and second sound ranges being substantially different from one another;

sensing the output of the first probe microphone in the first mode; and sensing the output of the first probe microphone in the second mode, and wherein the switchable circuit is an attenuator with ON/OFF states, the attenuator comprising:

a circuit connected to a switching device such that the circuit is connected to any one of the voltage levels comprising ground, virtual ground, or $V_{DD}$ when the switching device is switched on in the first mode and is disconnected from said voltage level when the switching device is switched off in the second mode, $V_{DD}$ representing the lower of two power supply levels connected to the attenuator.

5. The method of claim 4, wherein the circuit comprises a resistor and the switching device comprises a FET or a bipolar transistor.

6. The method of claim 5, wherein the circuit comprises at least one of a resistor and a capacitor connected in series.

* * * * *